US010326244B2

(12) United States Patent
Trout et al.

(10) Patent No.: US 10,326,244 B2
(45) Date of Patent: Jun. 18, 2019

(54) ELECTRICAL CONNECTOR AND ELECTRICAL CONTACT CONFIGURED TO REDUCE RESONANCE

(71) Applicant: TE CONNECTIVITY CORPORATION, Berwyn, PA (US)

(72) Inventors: David Allison Trout, Lancaster, PA (US); Jeffrey Byron McClinton, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 90 days.

(21) Appl. No.: 15/696,554

(22) Filed: Sep. 6, 2017

(65) Prior Publication Data

US 2019/0074636 A1 Mar. 7, 2019

(51) Int. Cl.

| | |
|---|---|
| ***H01R 13/648*** | (2006.01) |
| ***H01R 13/6474*** | (2011.01) |
| ***H01R 12/71*** | (2011.01) |
| ***H01R 13/05*** | (2006.01) |

(52) U.S. Cl.

CPC ..... *H01R 13/6474* (2013.01); *H01R 12/716* (2013.01); *H01R 13/05* (2013.01)

(58) Field of Classification Search

CPC ..... H01R 23/6893; H01R 23/7073; H01R 23/6873

USPC ..... 131/607.05, 607.11, 607.23, 607.08, 131/607.39

See application file for complete search history.

(56) References Cited

U.S. PATENT DOCUMENTS

| | | | | |
|---|---|---|---|---|
| 5,591,054 | A * | 1/1997 | Okada | H01R 13/04 439/884 |
| 7,766,664 | B2 * | 8/2010 | Cheng | H01R 12/7088 439/65 |
| 8,287,322 | B2 | 10/2012 | Jeon | |
| 8,512,081 | B2 | 8/2013 | Stokoe | |
| 8,550,861 | B2 | 10/2013 | Cohen et al. | |
| 8,727,791 | B2 | 5/2014 | Gulla | |
| 8,870,594 | B2 * | 10/2014 | McClellan | H01R 13/6587 439/607.05 |
| 8,894,442 | B2 * | 11/2014 | McClellan | H01R 13/6587 439/607.05 |

(Continued)

FOREIGN PATENT DOCUMENTS

CN 202019074 U 10/2011

*Primary Examiner* — Abdullah A Riyami
*Assistant Examiner* — Thang H Nguyen

(57) ABSTRACT

Electrical connector includes a connector housing and a plurality of electrical contacts coupled to the connector housing. Each of the electrical contacts includes a base section coupled to the connector housing and an elongated mating pin coupled to the base section. The mating pin extends away from the base section along a longitudinal axis to a contact end of the mating pin. The mating pin has an exterior surface that forms a runway configured to intimately engage another contact during a mating operation. The runway includes a wipe zone, a resonance-control zone, and a mating zone. The resonance-control zone is located between the mating zone and the wipe zone. The resonance-control zone has a greater elevation than an elevation of the wipe zone and an elevation of the mating zone such that the resonance-control zone deflects the other contact further away during the mating operation.

20 Claims, 7 Drawing Sheets

(56) References Cited

U.S. PATENT DOCUMENTS

| | | | | |
|---|---|---|---|---|
| 8,992,252 | B2 * | 3/2015 | McClellan | H01R 13/6587 439/607.05 |
| 9,077,094 | B2 * | 7/2015 | Minich | H01R 13/42 |
| 9,825,393 | B1 * | 11/2017 | Vino, IV | H01R 13/11 |
| 2005/0020135 | A1 * | 1/2005 | Whiteman, Jr. | H01R 13/6587 439/607.05 |
| 2005/0191907 | A1 * | 9/2005 | Scherer | H01R 23/688 439/607.05 |
| 2010/0144201 | A1 * | 6/2010 | Defibaugh | H01R 13/514 439/607.05 |
| 2012/0202395 | A1 * | 8/2012 | Gailus | H01R 13/26 439/889 |
| 2014/0099844 | A1 * | 4/2014 | Dunham | H01R 13/6473 439/887 |
| 2016/0036165 | A1 * | 2/2016 | Phillips | H01R 13/6461 439/607.05 |
| 2016/0141807 | A1 * | 5/2016 | Gailus | H01R 12/7076 439/607.05 |
| 2018/0198227 | A1 * | 7/2018 | Mundt | H01R 13/26 |

* cited by examiner

ELECTRICAL CONNECTOR AND ELECTRICAL CONTACT CONFIGURED TO REDUCE RESONANCE

BACKGROUND

The subject matter herein relates generally to electrical contacts having stub portions that generate an electrical resonance during operation.

Electrical connectors are used to transmit data in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as a wiping action, because each receptacle contact wipes along a contact surface of the corresponding header contact.

During this wiping action, each receptacle contact typically slides from a contact end of the corresponding header contact toward a mating zone along the header contact. The mating zone is a distance away from the contact end of the header contact. The portion of the header contact that extends between the contact end and the mating zone is referred to as a stub portion. During operation of the system, energy propagates from the mating zone to the contact end of the header contact where the energy is then reflected back toward the mating zone. At current transmission speeds the reflected energy may resonate, such that the stub portion acts as an antenna that enables electromagnetic radiation to permeate the interface between the mated header and receptacle contacts. Shielding may be required to contain such electromagnetic interference (EMI) radiated by stub portions acting as antennas, which may be costly and thereby increase the cost of manufacturing the connectors.

Accordingly, a need remains for electrical contacts that reduce the unwanted effects of reflected energy along stub portions of the electrical contacts.

BRIEF DESCRIPTION

In an embodiment, an electrical connector is provided that includes a connector housing configured to engage another connector. The electrical connector also includes a plurality of electrical contacts coupled to the connector housing. Each of the electrical contacts of the plurality of electrical contacts includes a base section coupled to the connector housing and an elongated mating pin coupled to the base section. The mating pin extends away from the base section along a longitudinal axis to a contact end of the mating pin. The mating pin has an exterior surface that forms a runway configured to intimately engage another contact during a mating operation. The runway includes a wipe zone, a resonance-control zone, and a mating zone. The resonance-control zone is located between the mating zone and the wipe zone. The resonance-control zone has a greater elevation than an elevation of the wipe zone and an elevation of the mating zone such that the resonance-control zone deflects the other contact further away during the mating operation.

In some aspects, the wipe zone and the mating zone are essentially planar.

In some aspects, each of the electrical contacts is stamped-and-formed from sheet material. The resonance-control zone is an embossed region of the sheet material.

In some aspects, the mating pin includes two panel sections having a contact gap therebetween. Optionally, the two panel sections are folded about a common fold edge. Optionally, only one of the two panel sections includes the resonance-control zone. The panel sections may be plated.

In some aspects, the mating pin includes an elongated opening that extends parallel to the longitudinal axis. The elongated opening defines a bow region of the mating pin that is permitted to flex. For example, the bow region is permitted to bow. The bow region includes the resonance-control zone.

In some aspects, the mating pin includes two panel sections having a contact gap therebetween that are folded about a common fold edge. The mating pin also includes an elongated opening that extends parallel to the longitudinal axis along the fold edge and one of the panel sections. The elongated opening defines a bow region of the one panel section that is permitted to flex. The bow region includes the resonance-control zone.

In an embodiment, a communication system is provided that includes a mating connector having a mating contact and an electrical connector comprising a connector housing and a plurality of electrical contacts coupled to the connector housing. Each of the electrical contacts of the plurality of electrical contacts includes a base section coupled to the connector housing and an elongated mating pin coupled to the base section. The mating pin extends away from the base section along a longitudinal axis to a contact end of the mating pin. The mating pin has an exterior surface that forms a runway configured to intimately engage another contact during a mating operation. The runway includes a wipe zone, a resonance-control zone, and a mating zone. The resonance-control zone is located between the mating zone and the wipe zone. The resonance-control zone has a greater elevation than an elevation of the wipe zone and an elevation of the mating zone such that the resonance-control zone deflects the other contact further away during the mating operation.

In some aspects, the mating contact has a contoured end segment and the connector housing has an interior surface. The contoured end segment and the interior surface are shaped relative to one another such that the contoured end segment is blocked by the interior surface of the connector housing prior to or during the mating operation.

In some aspects, the mating contact is configured to slidably engage the runway and move in an essentially linear direction along the runway during the mating operation. The wipe zone and the mating zone are essentially planar.

In some aspects, each of the electrical contacts is stamped-and-formed from sheet material. The resonance-control zone is an embossed region of the sheet material.

In some aspects, the mating pin includes two panel sections having a contact gap therebetween. The two panel sections are folded about a common fold edge, wherein only one of the two panel sections includes the resonance-control zone.

In some aspects, the mating pin includes an elongated opening that extends parallel to the longitudinal axis. The elongated opening defines a bow region of the mating pin that is permitted to flex. The bow region includes the resonance-control zone.

In some aspects, the mating contact includes first and second contact fingers that oppose each other with a contact-receiving space therebetween. The electrical contact is disposed between the contact-receiving space.

Optionally, the first contact finger has a contoured end segment and the connector housing has an interior surface. The contoured end segment of the first contact finger and the interior surface are shaped relative to one another such that the contoured end segment of the first contact finger is blocked by the interior surface of the connector housing. The second contact finger has a contoured end segment. The contoured end segment of the second contact finger and the interior surface are shaped relative to one another such that a flex gap exists between the contoured end segment of the second contact finger and the interior surface of the connector housing. The second contact finger is permitted to move during the mating operation In an embodiment, an electrical contact is provided that includes a base section and an elongated mating pin coupled to the base section. The mating pin extends away from the base section along a longitudinal axis to a contact end of the mating pin. The mating pin has an exterior surface that forms a runway configured to intimately engage another contact during a mating operation. The runway includes a wipe zone, a resonance-control zone, and a mating zone. The resonance-control zone is located between the mating zone and the wipe zone, wherein the resonance-control zone has a greater elevation than an elevation of the wipe zone and an elevation of the mating zone such that the resonance-control zone deflects the other contact further away during the mating operation.

In some aspects, the mating pin includes two panel sections folded about a common fold edge and having a contact gap therebetween. The mating pin also includes an elongated opening that extends parallel to the longitudinal axis along the fold edge and one of the panel sections. The elongated opening defines a bow region of the one panel section. The bow region is permitted to flex and includes the resonance-control zone.

In some aspects, the mating pin includes two panel sections having a contact gap therebetween. The two panel sections are folded about a common fold edge, wherein only one of the two panel sections includes the resonance-control zone.

In some aspects, the mating pin includes an elongated opening that extends parallel to the longitudinal axis. The elongated opening defines a bow region of the mating pin that is permitted to flex. The bow region includes the resonance-control zone.

DETAILED DESCRIPTION

Figure 1:
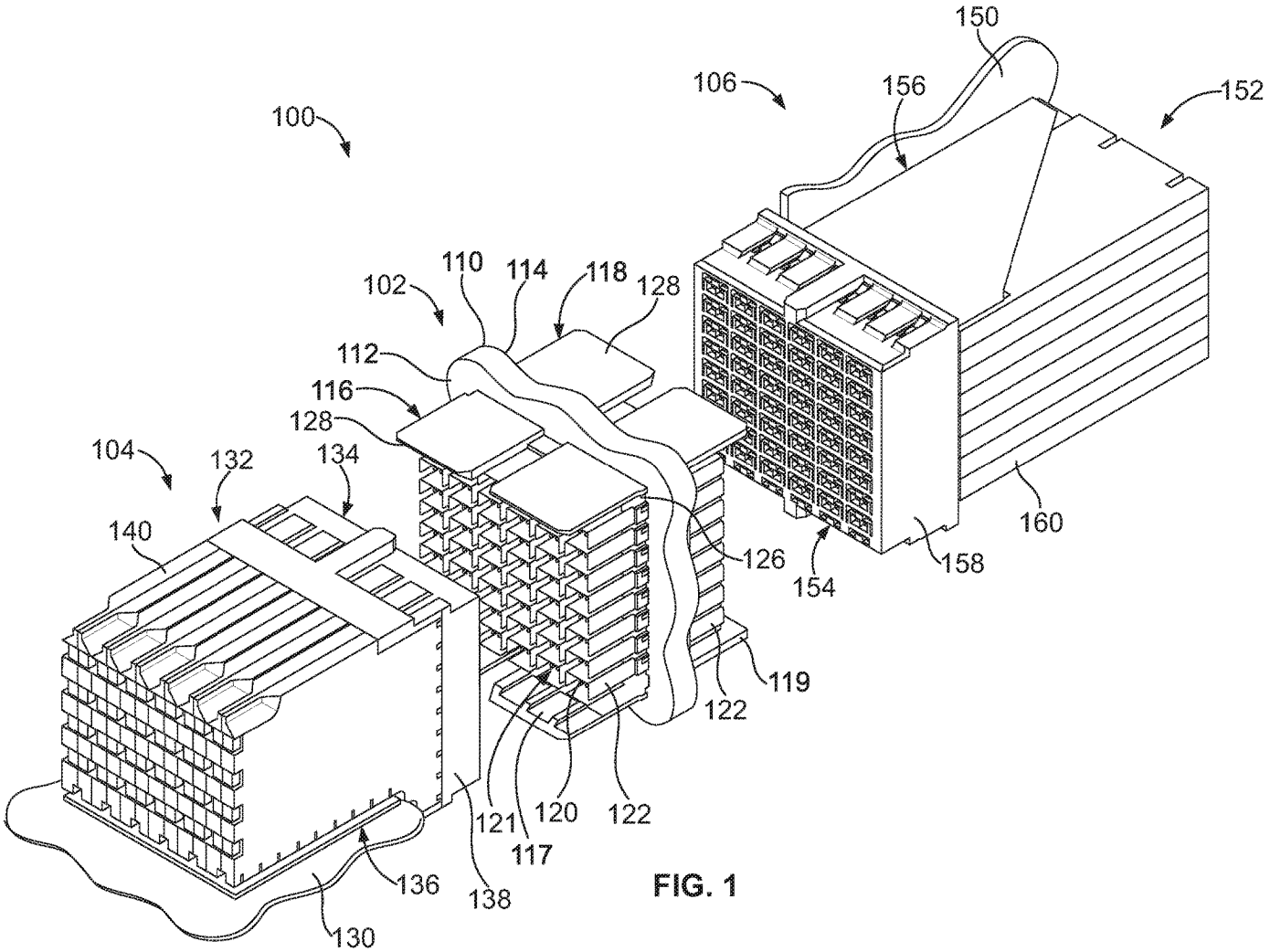
FIG. 1 is a front perspective view of a communication system formed in accordance with an embodiment.

Embodiments set forth herein may include electrical contacts, electrical connectors having the electrical contacts, connector assemblies including the electrical connectors, and communication systems having the electrical connectors, among other things. Embodiments may be configured to improve electrical performance by, for example, damping or impeding electrical resonance that may occur in stub portions of electrical contacts. More specifically, electrical contacts may include a protrusion that forms a resonance-control zone where the electrical contact engages another contact.

The electrical contacts may form signal paths in which data signals are transmitted through the electrical contacts. Alternatively, the electrical contacts may form ground conductors in which each ground conductor shields adjacent signal paths from one another and provides a return path. Each electrical contact is configured to be engaged by another contact at a contact zone. The contact zone is located a distance away from an end of the electrical contact thereby forming the stub portion. More specifically, the stub portion is the portion of the electrical contact in which energy resonates between the end of the electrical contact and the contact zone.

In some embodiments, the electrical connectors are configured to mate with other electrical connectors during a mating operation. During the mating operation, a first electrical contact of one connector may engage and slide (or wipe) along a second electrical contact of the other connector. The second electrical contact may include, among other things, a wipe runway. The first electrical contact slides along the wipe runway of the second electrical contact and operably engages the second electrical contact at the contact zone.

Although the illustrated embodiment includes electrical connectors that are used in high-speed communication systems, such as, but not limited to, backplane or midplane communication systems, it should be understood that embodiments may be used in other communication systems and/or in other systems/devices that utilize electrical contacts having stub portions. It should also be understood that embodiments do not require a wiping action between two electrical contacts. Accordingly, the inventive subject matter is not limited to the illustrated embodiment.

In particular embodiments, the electrical contacts provide signal pathways for transmitting data signals. Embodiments may be particularly suitable for communication systems, such as, but not limited to, network systems, servers, data centers, and/or the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the STRADA Whisper or Z-PACK TinMan product lines developed by TE Connectivity. The electrical connectors may include high-density arrays of electrical contacts. A high-density array may have, for example, at least 12 signal contacts per 100 $mm^2$ along the mating side or the mounting side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

Electrical contacts described herein may include a plurality of different materials. For example, an electrical contact may include a base material, such as, but not limited to, copper or copper alloy (e.g., beryllium copper), that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

Different materials of an electrical contact may be selected to impede electrical resonance along any stub portions. For example, one or more of the materials used in the electrical contacts may be ferromagnetic. More specifically, one or more materials may have a higher relative magnetic permeability. In particular embodiments, the electrical contact includes a material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, alloys of the same, and/or the like. In some embodiments, the material is a martensitic stainless steel (annealed). Materials that have a higher permeability provide a higher internal self-inductance. High permeability may also cause shallow skin depths, which may increase the effective resistance of the electrical contact within a predetermined frequency band.

As used herein, phrases such as "a plurality of [elements]" and "an array of [elements]" and/or the like, when used in the detailed description and claims, do not necessarily include each and every element that a component may have. The component may have other elements that are similar to the plurality of elements. For example, the phrase "a plurality of electrical contacts [being/having a recited feature]" does not necessarily mean that each and every electrical contact of the component has the recited feature. Other electrical contacts may not include the recited feature. Accordingly, unless explicitly stated otherwise (e.g., "each and every electrical contact of the electrical connector [being/having a recited feature]"), embodiments may include similar elements that do not have the recited features.

In order to distinguish similar elements in the detailed description and claims, various labels may be used. For example, an electrical connector may be referred to as a header connector, a receptacle connector, and/or a mating connector. Electrical contacts may be referred to as header contacts, receptacle contacts, and/or mating contacts. When similar elements are labeled differently (e.g., receptacle contacts and mating contacts), the different labels do not necessarily require structural differences.

Embodiments set forth herein are described with respect a backplane or midplane communication system having a central printed circuit board (PCB). Header connectors are mounted to each side of the PCB. The header connectors include electrical contacts, such as the electrical contacts described herein. Conductive pathways extend through the PCB via plated thru-holes (PTHs) and conductive traces. The conductive pathways electrical connect different electrical contacts of the header connectors. Receptacle daughtercards are mated to the header connectors on both sides of the PCB.

Yet alternative configurations of such communication systems exist. In one configuration, the header connectors are mounted to only one side of the PCB and receptacle daughtercards are mated to the same side. In another configuration (referred to as a direct plug orthogonal (DPO) configuration), a central PCB does not exist. Mezzanine (parallel) PCB configurations are also contemplated. Accordingly, it should be understood that the electrical contacts set forth herein may be used in a number of different applications.

FIG. 1 is a perspective view of a communication system 100 formed in accordance with an embodiment. The communication system 100 is an electrical connector system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, either of the first and second connector systems 104, 106 may be part of a line card assembly or a switch card assembly. Although the communication system 100 is configured to interconnect two connector systems in the illustrated embodiment, other communication systems may interconnect more than two connector systems or, alternatively, interconnect a single connector system to another communication device.

Figure 4:
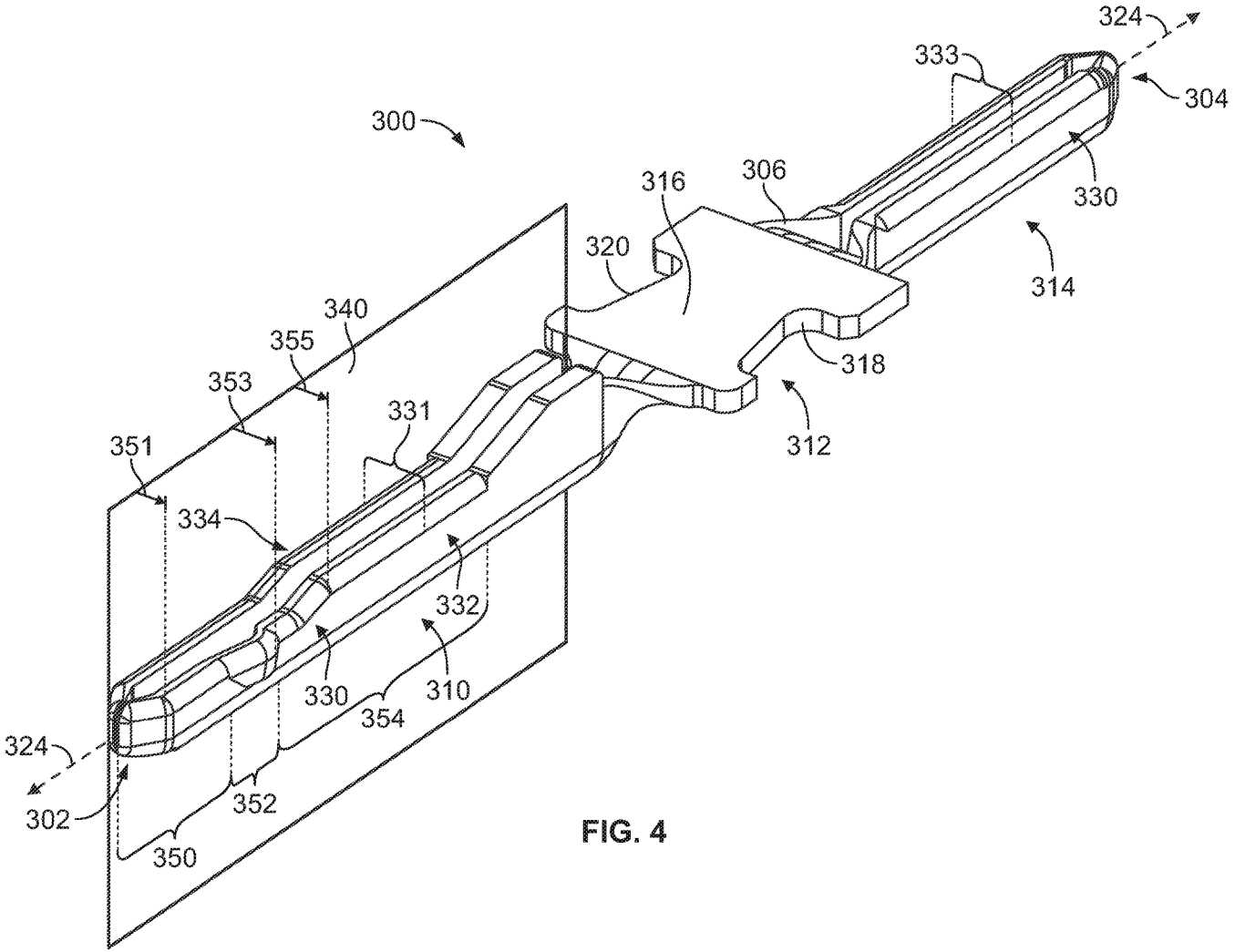
FIG. 4 is an isolated perspective view of an electrical contact formed in accordance of an embodiment.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120. The electrical contacts 120 may be similar to the electrical contacts 300 (FIG. 4).

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

In other embodiments, the system may have a DPO configuration in which a mid-plane or backplane circuit board does not exist. In such embodiments, a single connector may be used to interconnect two receptacle connectors more directly. The electrical contact 300 (shown in FIG. 4) may be used in such embodiments.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as, but not limited to, a plastic material. Each of the connector housings 117, 119 includes a mounting wall 126 that is configured to be mounted to the circuit board 110, and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a connector housing 138. The connector housing 138 may be referred to as a front housing or shroud in some embodiments. The connector housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (FIG. 3) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
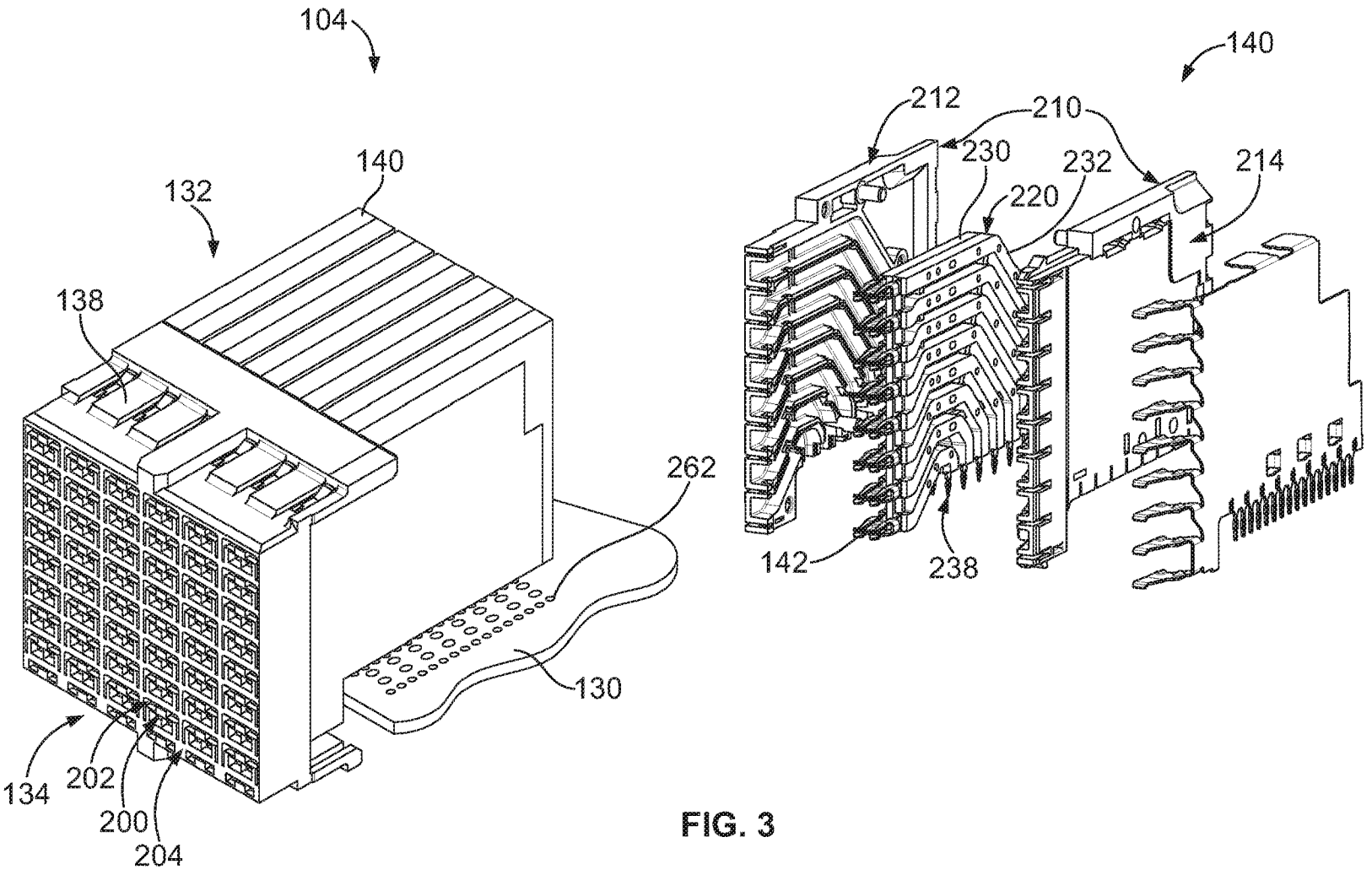
FIG. 3 is a perspective view of a receptacle connector that may be used with the communication system of FIG. 1.

Similar to the first receptacle connector 132, the second receptacle connector 152 includes a connector housing 158 used to hold a plurality of contact modules 160. The connector housing 158 may be referred to as a front housing or shroud in some embodiments. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
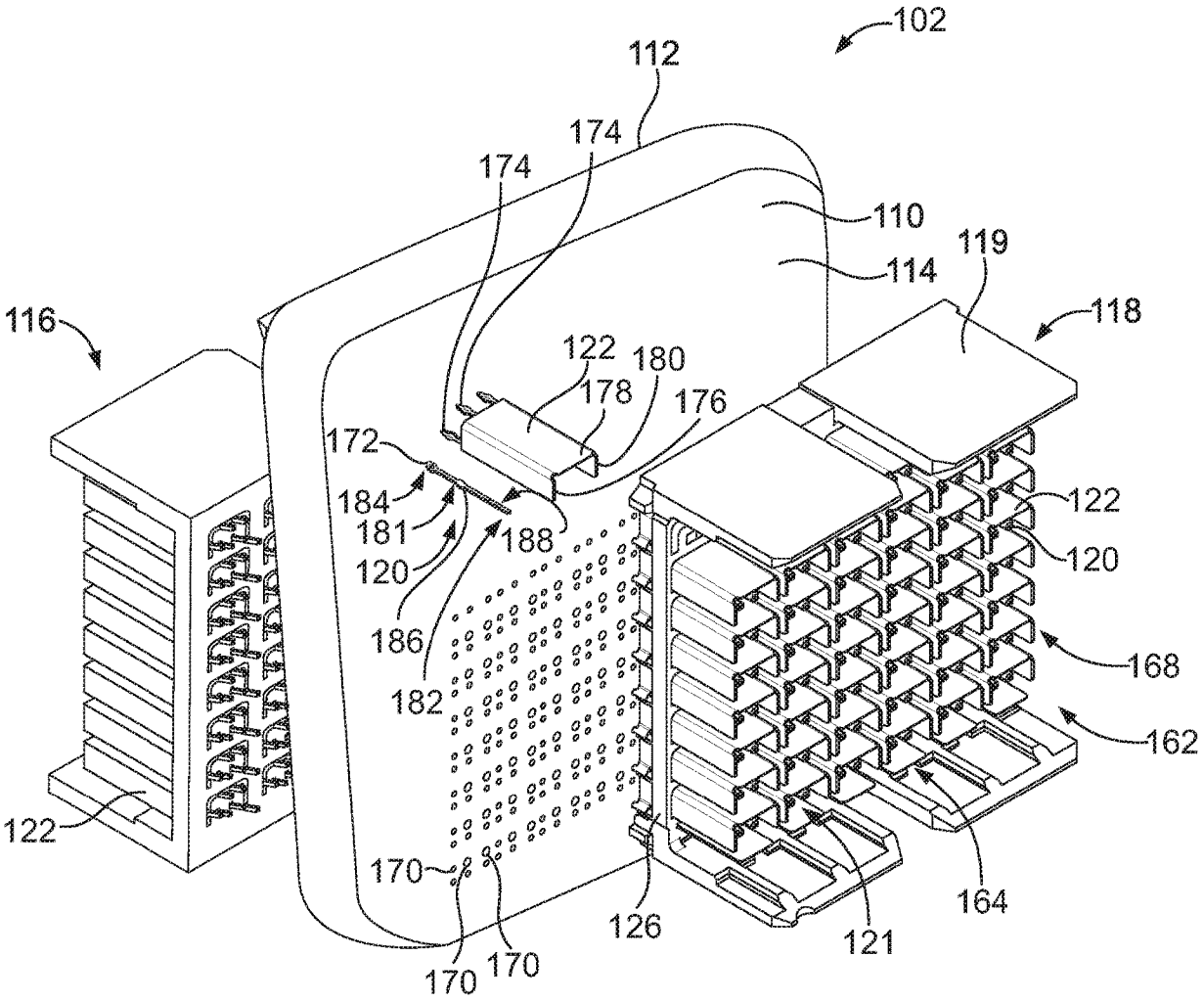
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a contact end 162 that faces away from the second board side 114 of the circuit board 110. The connector housing 119 defines a housing cavity 164 that opens to the contact end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include mating pins 172 that are configured to be loaded into corresponding conductive vias 170. The mating pins 172 mechanically engage and electrically couple to the conductive vias 170. Likewise, at least some of the conductive vias 170 are configured to receive mating pins 174 of the ground shields 122. The mating pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, specifically three planar walls 176, 178, 180. The planar walls 176, 178, 180 may be integrally formed or alternatively, may be separate pieces. The mating pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

The header contact 120 includes a contact end 182 and a back end 184. A conductive pathway exists between the contact and back ends 182, 184. The back end 184 is configured to engage the circuit board 110. The contact end 182 may represent the portion of the header contact 120 that is located furthest from the circuit board 110 or the mounting wall 126 and is the first to engage or interface with the second receptacle connector 152 (FIG. 1). As such, the contact end 182 may also be referred to as the leading end or the mating end.

The header contact 120 also includes a contact body 181. The header contact 120 (or the contact body 181) includes a plurality of segments that are shaped differently from one another and may have different functions. For example, the header contact 120 includes the mating pin 172, a base section 186, and a mating segment 188. The mating pin 172 includes the back end 184, and the mating segment 188 includes the contact end 182. As described above, the mating pin 172 mechanically engages and electrically couples to a corresponding conductive via 170 of the circuit board 110.

The base section 186 is sized and shaped to directly engage the mounting wall 126 of the connector housing 119. For example, the base section 186 may be inserted into a passage (not shown) of the mounting wall 126 and engage the mounting wall 126 to form an interference fit therewith.

The mating segment 188 may represent the portion of the header contact 120 that is exposed within the housing cavity 164. As described below, the mating segment 188 (or a portion thereof) is configured to slidably engage a corresponding receptacle contact 142 (FIG. 3) during the mating operation.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The connector housing 138 includes a plurality of contact openings 200, 202 at a contact end 204 of the connector housing 138. The contact end 204 defines the mating interface 134 of the first receptacle connector 132 that engages the first header connector 116 (FIG. 1).

The contact modules 140 are coupled to the connector housing 138 such that the receptacle contacts 142 are received in corresponding contact openings 200. Optionally, a single receptacle contact 142 may be received in each contact opening 200. The contact openings 200 receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The connector housing 138 may be manufactured from a dielectric material, such as, but not limited to, a plastic material, and may provide isolation between the contact openings 200 and the contact openings 202. The connector housing 138 may isolate the receptacle contacts 142 and the header contacts 120 from the ground shields 122. In some embodiments, the contact module 140 includes a conductive holder 210. The conductive holder 210 may include a first holder member 212 and a second holder member 214 that are coupled together. The holder members 212, 214 may be fabricated from a conductive material. As such, the holder members 212, 214 may provide electrical shielding for the first receptacle connector 132. When the holder members 212, 214 are coupled together, the holder members 212, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through a corresponding signal conductor (not shown).

FIG. 4 is an isolated perspective view of an electrical contact 300. The electrical contact 300 includes features that are similar to the header contact 120 (FIG. 1). An electrical connector, such as the electrical connector 116, may include a plurality of the electrical contacts 300 coupled to the connector housing. The electrical contact 300 may be configured to directly engage two contacts from different connectors (e.g., receptacle connectors). Unlike the header contact 120, the electrical contact 300 does not directly engage a circuit board. However, alternative embodiments of the electrical contact 300 may be configured to replace the header contact 120 in the communication system 100. The electrical contact 300 may be stamped-and-formed from sheet material, although other processes may be contemplated.

The electrical contact 300 includes first and second contact ends 302, 304. A conductive pathway exists between the first and second contact ends 302, 304. The first contact end 302 is configured to engage another contact, such as the electrical contact 402 (FIG. 7) (hereinafter referred to as "another contact" or "the other contact"). In the illustrated embodiment, the second contact end 304 is also configured to engage another contact (not shown), which may be similar or identical to the other contact 402. Alternatively, the second contact end 304 may be configured to engage a circuit board. The first contact end 302 may represent the portion of the electrical contact 300 that is located furthest from the connector housing and is first to engage the other contact 402. As such, the first contact end 302 may also be referred to as the leading end or the mating end.

The electrical contact 300 has a contact body 306. The electrical contact 300 (or the contact body 306) includes a plurality of sections that are shaped differently from one another and may have different functions. For example, the electrical contact 300 (or the contact body 306) includes a first elongated mating pin 310, a base section 312, and a second elongated mating pin 314. The first mating pin 310 includes the first contact end 302, and the second mating pin 314 includes the second contact end 304.

The base section 312 extends between and mechanically and electrically couples the first and second mating pins 310, 314. The first and second mating pins 310, 312 extend in opposite directions from the base section 312. The base section 312 is sized and shaped to mechanically couple to a connector housing. For example, the base section 312 may form an interference fit with the mounting wall 126 (FIG. 1) of the connector housing 119 (FIG. 1). In the illustrated embodiment, the base section 312 has a planar body 316 defined between opposite edges 318, 320. The body 316 and the edges 318, 320 are shaped to engage the connector housing.

Each of the first and second mating pins 310, 314 extends away from the base section 312 along a longitudinal axis 324 to the respective contact end of the mating pin. The first mating pin 310 has a width 331. As described herein, the width 331 may change along mating pin 310 due to a protrusion. The second mating pin 314 has an essentially uniform width 331 and does not include a protrusion.

Each of the longitudinal axes 324 extends through a geometric center of a cross-sectional profile of the respective mating pin. In the illustrated embodiment, the longitudinal axes 324 appear to be straight lines. In other embodiments, however, the longitudinal axes 324 may bend as the shape of the respective mating pin changes along a length of the electrical contact 300. The different longitudinal axes 324 may coincide with one another or, in other words, be the same axis. Yet in other embodiments, the mating pins 310, 314 are shaped differently such that the longitudinal axes 324 do not coincide.

Each of the first and second mating pins 310, 314 has an exterior surface 330. In the illustrated embodiment, the exterior surfaces 330 are nearly identical, except for a resonance-control zone (described below). In alternative embodiments, the first and second mating pins 310, 314 may be identical. The exterior surface 330 includes opposite first and second runways 332, 334. The first runway 332 is configured to engage a first contact finger 402 (shown in FIG. 7) of the other contact 402 (FIG. 7), and the second runway 334 is configured to engage a second contact finger 404 (shown in FIG. 7) of the other contact. The other contact 402 may be a receptacle contact in which the first and second contact fingers 402, 404 oppose each other and are configured to receive the electrical contact 300 therebetween. The first and second contact fingers 402, 404 are configured to deflect and slidably engage the first and second runways 332, 334 of the exterior surface 330.

As shown in FIG. 4, a plane 340 intersects the first mating pin 310. The first runway 332 and the second runway 334 face away from the plane 340 in opposite directions. The electrical contact 300 and the other contact 402 (FIG. 7) are configured to engage each other during a mating operation in which the electrical contact 300 and the other contact 402 move relatively toward one another along the longitudinal axis 324. In the illustrated embodiment, the other contact 402 is moved toward the electrical contact 300, but it is also contemplated that the electrical contact 300 may move toward the other contact or that both contacts may move toward each other at the same time.

The first runway 332 includes a wipe zone 350, a resonance-control zone 352, and a mating zone 354. The resonance-control zone 352 is located between the mating zone 354 and the wipe zone 350. The wipe zone 350 extends between the resonance-control zone 352 and the first contact end 302. The mating zone 354 extends between the resonance-control zone 352 and the base section 306.

As shown, the resonance-control zone 352 has an elevation (or dimension) 353 relative to the plane 340 that is different than a corresponding elevation 351 of the wipe zone 350 and a corresponding elevation 355 of the mating zone 354. In the illustrated embodiment, the elevations 351, 355 of the wipe zone 350 and the mating zone 354, respectively, are essentially the same. The elevation 353 of the resonance-control zone 352 is greater than each of the elevations 351, 355. The difference between the elevation 353 and one or both of the elevations 351, 355 may be, for example, between 0.04 and 0.15 millimeters (mm). With respect to the resonance-control zone 352 and the mating zone 354, the difference may be measured from a top of the resonance-control zone 352 to where the other contact engages the mating zone 354, such as the localized area 470 (shown in FIG. 7) of the mating zone 354.

In some embodiments, the difference between the elevation 353 and one or both of the elevations 351, 355 may be between 0.05 and 0.12 mm. In more particular embodiments, the difference between the elevation 353 and one or both of the elevations 351, 355 may be between 0.06 and 0.10 mm. As one particular example, the difference between the elevation 353 and the elevations 351, 355 is about 0.08 mm. However, the difference in elevation may be less or greater than the examples above in other embodiments. In the illustrated embodiment, the wipe zone 350 and the mating zone 354 are essentially planar, but it is contemplated that one or more shaped features may be permitted. In particular embodiments, the wipe zone 350 and the mating zone 354 are essentially planar and the resonance-control zone 352 (or protrusion) 370 is the only shaped feature.

As shown in FIG. 4, the second runway 334 is essentially planar and does not include changes in elevation. In alternative embodiments, however, the second runway 334 may be shaped similar or identical to the first runway 332.

Figure 5:
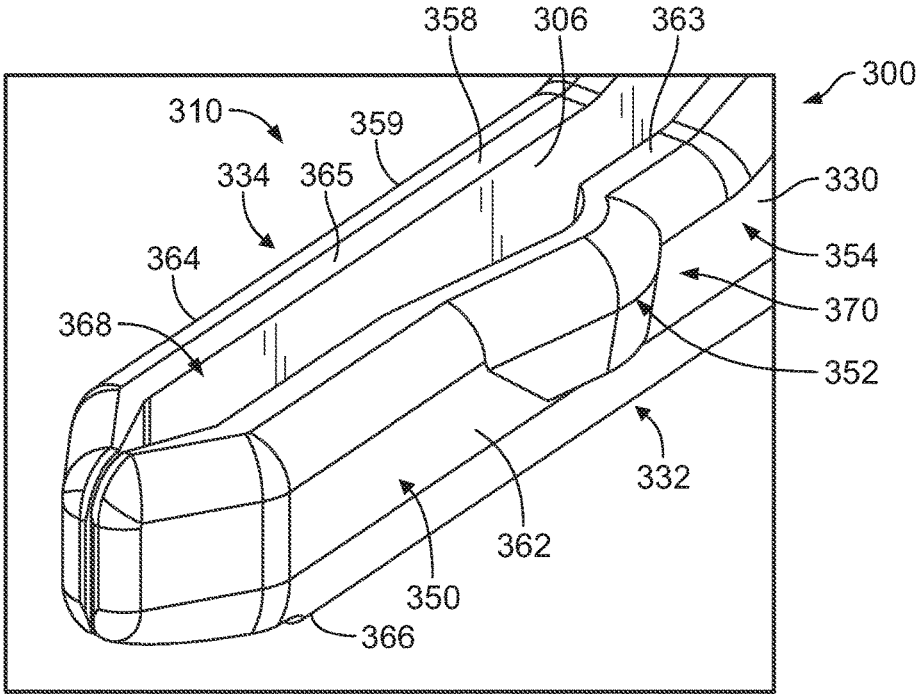
FIG. 5 is an enlarged view of a mating pin of the electrical contact of FIG. 4.
Figure 6:
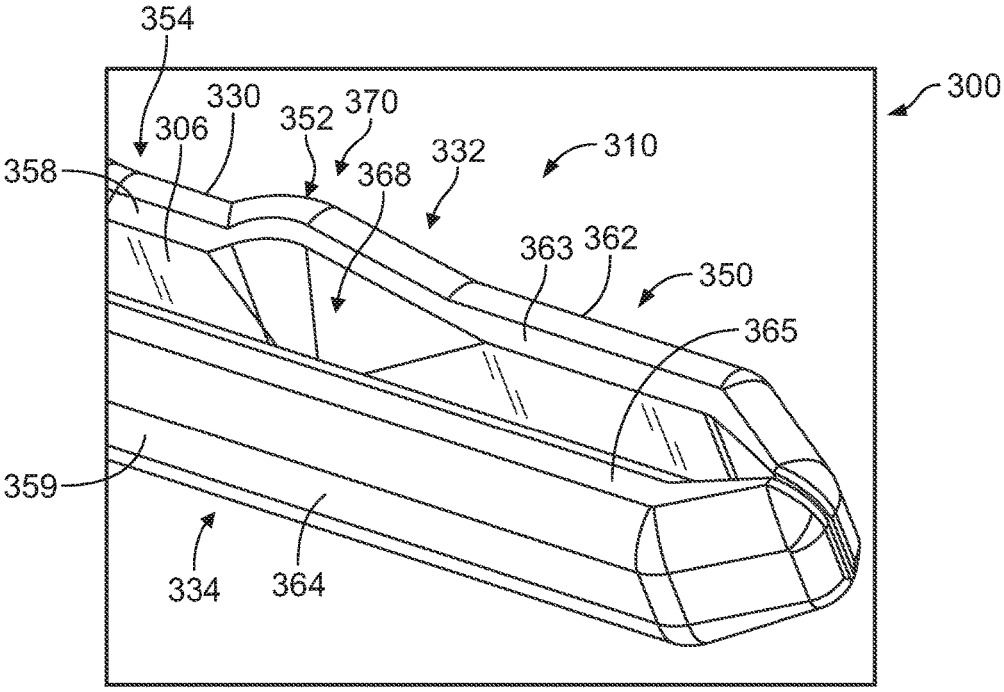
FIG. 6 is another enlarged view of the mating pin of the electrical contact of FIG. 4.

FIGS. 5 and 6 are enlarged views of the first mating pin 310. In some embodiments, the electrical contact 300 is stamped-and-formed from sheet material, such as sheet metal 358. Before or after shaping the sheet metal 358, the sheet metal 358 may be coated with a material to form a contact plating 359. The contact plating 359 may comprise, for instance, a gold alloy. One or more additional layers (not shown) may exist that define the sheet metal 358 and/or the contact plating 359.

The contact body 306 may include first and second panel sections 362, 364 that are coupled to one another and folded about a common fold edge 366 (FIG. 5). A contact gap 368 exists between the first and second panel sections 362, 364. The first panel section 362 includes the first runway 332 and has a first panel edge 363, and the second panel section 364 includes the second runway 334 and has a second panel edge 365. As shown in FIGS. 5 and 6, the first panel section 362 includes a protrusion 370. The protrusion 370 is a localized region of the first panel section 362 that is a topological deviation (e.g., abrupt change in elevation) from the surrounding surface. For example, the protrusion 370 may be an embossed or dimpled region of the sheet material. In the illustrated embodiment, the protrusion 370 does not cover an entire height or width of the first panel section 362 or of the first mating pin 310. The first panel edge 363 includes the protrusion 370. The second panel section 362 does not include a similar protrusion in the illustrated embodiment, but it is contemplated that alternative embodiments may include a protrusion.

The first panel section 362 is bent or otherwise shaped to form the protrusion 370, thereby providing different elevations along the first runway 332. The resonance-control zone 352 of the first runway 332 corresponds to the protrusion 370. More specifically, the resonance-control zone 352 corresponds to the exterior surface 330 along the protrusion 370. The portions of the first panel section 362 corresponding to the wipe zone 350 and the mating zone 354 are not bent or otherwise shaped.

Also shown in FIGS. 5 and 6, the first contact end 302 is defined by the first and second panel sections 362, 364. The first and second panel sections 362, 364 at the first contact end 302 may be bent toward one another to provide a tapering or chamfered contact end, which may reduce the likelihood of the other contact being damaged during the mating operation.

Figure 7:
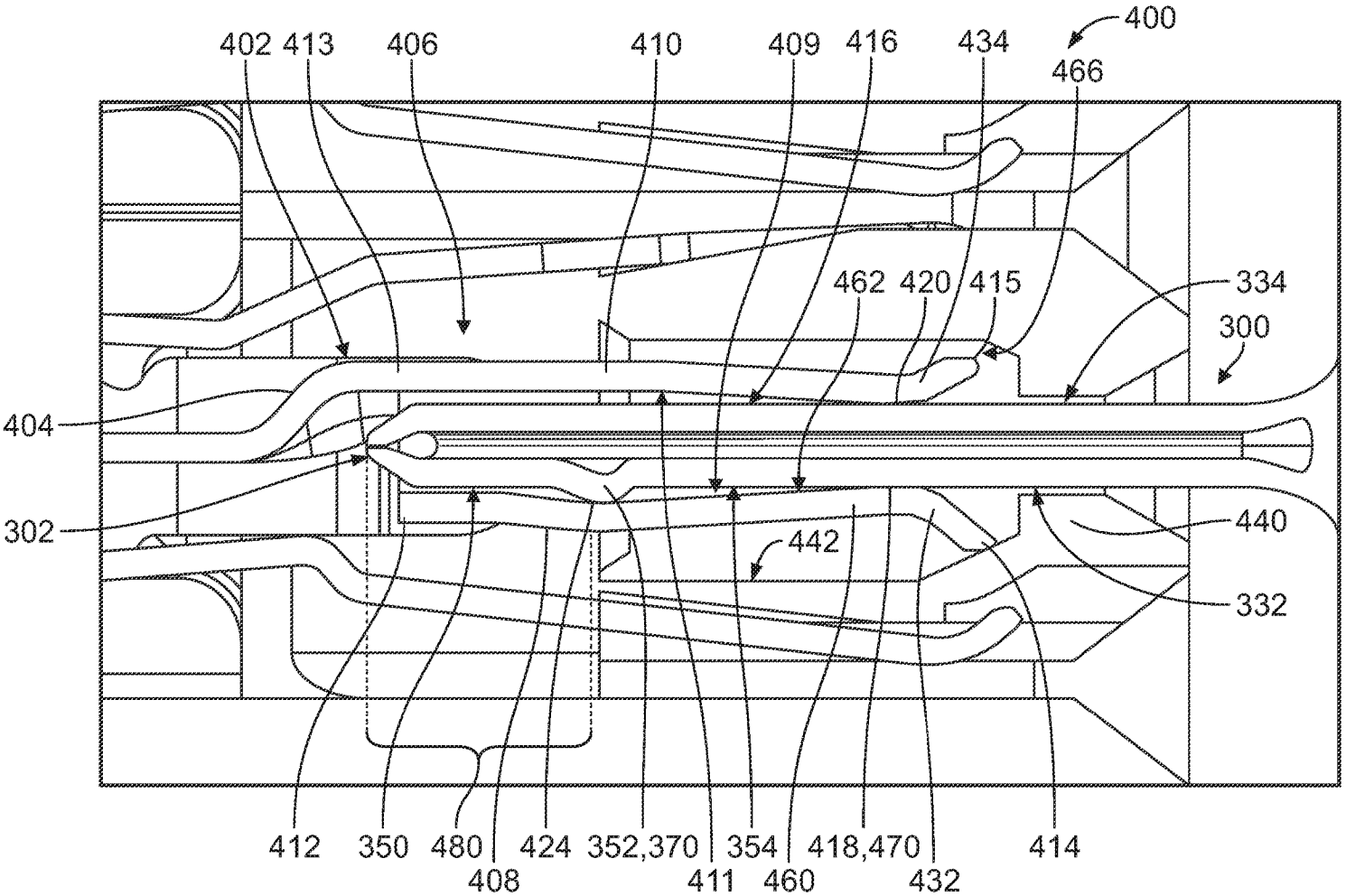
FIG. 7 is a cross-section of a connector assembly as the electrical contact of FIG. 4 engages another contact.

FIG. 7 is a cross-section of a portion of a communication system 400 after the electrical contact 300 and the other contact 402 are fully mated. FIG. 7 includes a side view of a portion of the other contact 402. The other contact 402 is part of a mating connector, such as the receptacle connector 132 (FIG. 1). The other contact 402 includes a base portion 404 and a mating portion 406 that is coupled to the base portion 404. Although not shown, the other contact 402 may include a terminal portion that is coupled to a conductor of the mating connector.

The mating portion 406 is configured to engage the electrical contact 300 to establish an electrical connection between the electrical contact 300 and the other contact 402. The mating portion 406 includes at least one contact finger. For example, the mating portion 406 includes a first contact finger 408 and a second contact finger 410. The first and second contact fingers 408, 410 are coupled to the base portion 404. The first and second contact fingers 408, 410 have respective joints 412, 413 that directly connects to the base portion 404. The first and second contact fingers 408, 410 have respective distal tips 414, 415. The first and second contact fingers 408, 410 extend lengthwise between the respective joints 412, 413 and the respective distal tips 414, 415.

In the illustrated embodiment, the first and second contact fingers 408, 410 are spring contacts that are configured to be resiliently deflected when engaged with the electrical contact 300. The first and second contact fingers 408, 410 have respective engagement surfaces 409, 411. A contact-receiving space 416 exists between the engagement surfaces 409, 411 and represents a space that will receive the electrical contact 300. The engagement surface 409 is shaped to define a primary contact zone 418 of the first contact finger 408, and the engagement surface 411 is shaped to define a primary contact zone 420 of the second contact finger 410. The first contact finger 408 may also be shaped (relative to the electrical contact 300) to define a stub-contact zone 424 in which the first contact finger 408 engages the resonance-control zone 352 (or protrusion 370) of the electrical contact 300.

As shown in FIG. 7, the first contact finger 408 has a contoured end segment 432 that extends between the primary contact zone 418 and the distal tip 414. The second contact finger 410 has a contoured end segment 434 that extends between the contact zone 420 of the second contact finger 410 and the distal tip 415. In FIG. 7, the contoured end segment 432 of the first contact finger 408 is longer than the contoured end segment 434 of the second contact finger 410. The contoured end segment 432 may be sized and shaped relative to a connector housing 440 of the mating connector such that the contoured end segment 432 engages the connector housing 440 prior to or during the mating operation. The connector housing 440 may block movement of the contoured end segment 432 while permitting the first contact finger 408 to bow when the stub-contact zone 424 engages the electrical contact 300.

During a mating operation, as the electrical contact 300 is inserted into the contact-receiving space 416 of the other contact 402, the primary contact zones 418, 420 engage the first and second runways 332, 334, respectively, thereby deflecting the first and second contact fingers 408, 410, respectively. The other contact 402 is configured to slidably engage the runway 332 and relatively move in an essentially linear direction, except for the deflection, along the runway 332 during the mating operation. The primary contact zone 418 slides along the wipe zone 350, the resonance-control zone 352, and the mating zone 354. In the fully mated position (as shown in FIG. 7) the primary contact zone 418 presses against a localized area 470 of the mating zone 354. In the illustrated embodiment, the mating zone 354 does not include any additional increases in elevation from the protrusion 370 to at least the localized area 470. In the illustrated embodiment, the mating zone 354 is essentially planar from the protrusion 370 to at least the localized area 470. As the primary contact zone 418 slides (or wipes) along the first runway 332, the primary contact zone 420 slides (or wipes along) the second runway 334. The first contact finger 408 experiences an additional deflection as the first contact finger 408 engages the resonance-control zone 352 (or the protrusion 370). In the illustrated embodiment, the second contact finger 410 does not experience an additional deflection because the runway 334 does not include a protrusion.

Due to the resonance-control zone 352 (or the protrusion 370), the primary contact zone 418 of the first contact finger 408 may be deflected away from the first runway 332. After the primary contact zone 418 clears the protrusion 370, the engagement surface 409 may engage and slide along the protrusion 370. To reduce the likelihood of the primary contact zone 418 being separate from the mating zone of the first runway 332, the first contact finger 408 may be shaped to extend inwardly toward the first runway 332. For example, a proximate section 460 of the first contact finger 408 that includes the contoured end segment 432 may be bent toward the first runway 332 at a point 462. The proximate section 460 may be bent to a greater degree than a similar section of the second contact finger 410.

Alternatively or in addition to the proximate section 460, the contoured end segment 432 and/or an interior surface 442 of the connector housing 440 may be shaped to reduce the likelihood of the primary contact zone 418 being separate from the first runway 332 during operation. For example, the contoured end segment 432 may be blocked from moving during the mating operation by the interior surface 442 of the connector housing 440. The contoured end segment 432 and/or the interior housing 440 may be shaped such that the contoured end segment 432 is either (a) separate from the interior surface 442 prior to the mating operation and then engages the interior surface 442 during the mating operation or (b) engaged with (e.g., pressed against) the interior surface prior to the mating operation. Because the contoured end segment 432 is blocked by the connector housing 440, the portion of the first contact finger 408 between the primary contact zone 418 and the stub-contact zone 424 may not move away from the first runway 332. More specifically, the interior surface 442 of the connector housing 440 may block movement of the contoured end segment 432 away from the first runway 332 while permitting the first contact finger 408 to bow as the resonance-control zone 352 (or the protrusion 370) slidably engages the engagement surface 409 of the first contact finger 408.

In some embodiments, the contoured end segment 434 of the second contact finger 410 is separated from the interior surface 442 of the connector housing 440 by a flex gap 466. The flex gap 466 permits movement of the second contact finger 410 during the mating operation. Permitting the second contact finger 410 to move may reduce the mating force necessary for mating the electrical contact 300 with the first contact finger 408. For example, the first contact finger 408 may be blocked from moving by the connector housing 440 as described herein. Unlike other electrical contacts, the electrical contact 300 engages the first contact finger 408 at two separates points (e.g., the primary contact zone 418 and the stub-contact zone 424). The frictional forces generated by the first contact finger 408 and the first runway 332 of the electrical contact 300 may be greater when the first contact finger 408 is not permitted to be deflected further away. In such instances, the flex gap 466 (and compliance of the second contact finger 410) may enable a mating operation that requires less force.

In some embodiments, the electrical contact 300 and/or the connector housing (not shown in FIG. 7) that is coupled to the electrical contact 300 may permit at least some deflection of the electrical contact 300 in a direction toward the second contact finger 410. The flex gap 466 (and compliance of the second contact finger 410) may permit the deflection of the electrical contact 300 without a significant increase in the frictional forces generated. Frictional forces generated between the first contact finger 408 and the electrical contact 300 may be reduced by permitting the electrical contact 300 to be deflected toward the second contact finger 410.

In the illustrated embodiment, the electrical contact 300 includes a stub portion 480. The stub portion 480 is defined between the resonance-control zone 352 and the first contact end 302. Without the resonance-control zone 352 (or the protrusion 370), the stub portion of the electrical contact 300 would extend from the first contact end 302 to the primary contact zone 418. Accordingly, the contact 402 may engage the electrical contact 300 at two different areas along the same surface thereby reducing the size of an electrical path taken by reflected energy. As such, embodiments provide a mechanism for controlling or reducing the electrical length of the stub portion while also allowing a wipe distance that is within tolerances.

Figure 8:
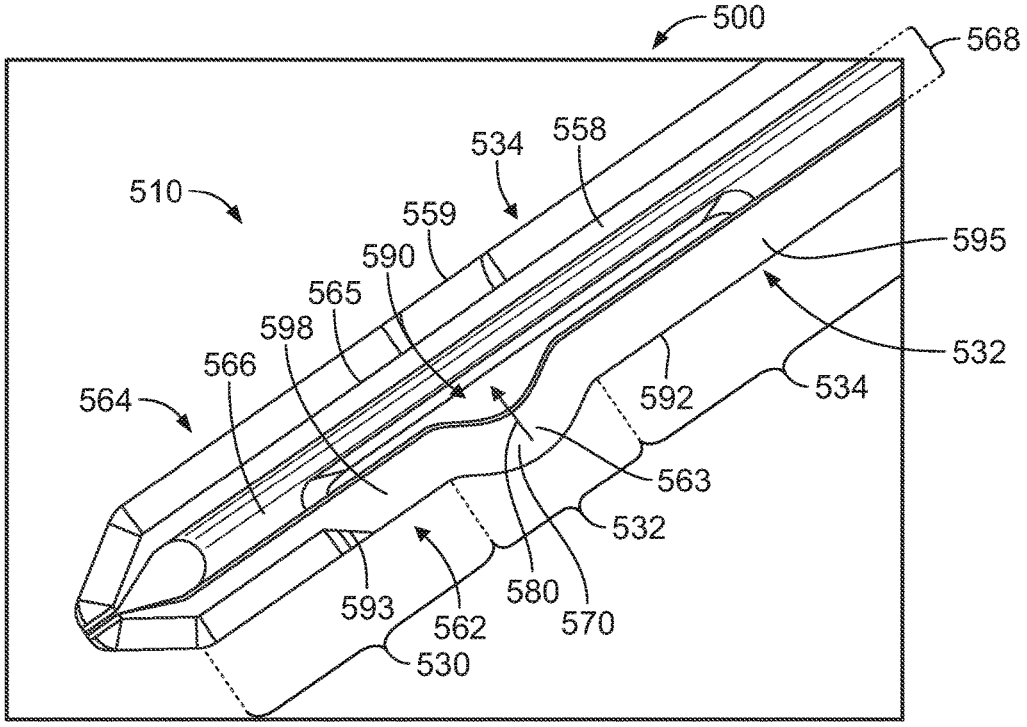
FIG. 8 is an enlarged view of a mating pin of an electrical contact formed in accordance with an embodiment.
Figure 9:
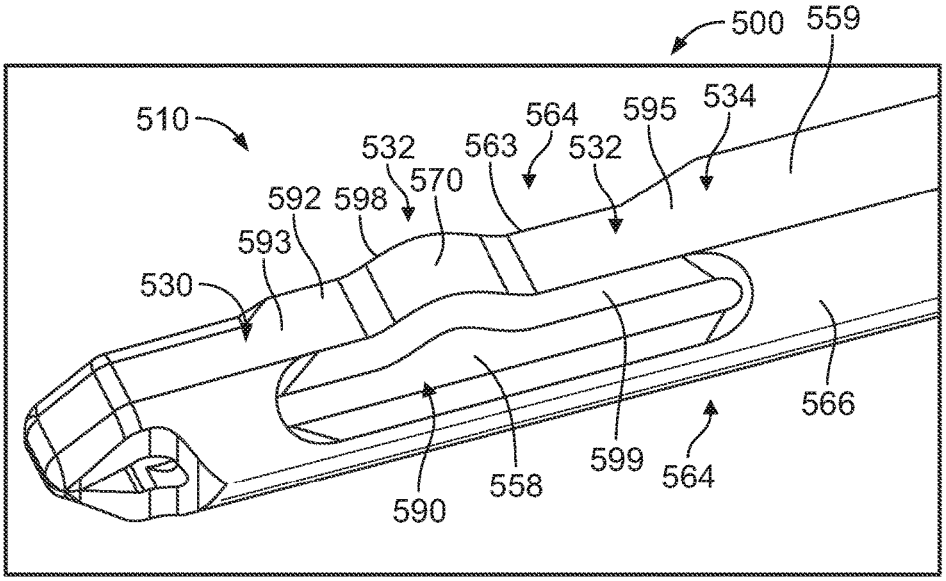
FIG. 9 is another enlarged view of the mating pin of the electrical contact of FIG. 8.

FIGS. 8 and 9 are enlarged views of a mating pin 510 of an electrical contact 500. The electrical contact 500 may be similar to the electrical contact 300 (FIG. 4). For example, the electrical contact 500 may be stamped-and-formed from sheet metal 558. Before or after shaping the sheet metal 558, the sheet metal 558 may be coated with a material to form a contact plating 559. The contact plating 559 may comprise, for instance, a gold alloy. One or more additional layers (not shown) may exist that define the sheet metal 558 and/or the contact plating 559. Like the electrical contact 300, the electrical contact 500 includes a wipe zone 530, a resonance-control zone 532, and a mating zone 534 along the mating pin 510.

The mating pin 510 may include first and second panel sections 562, 564 that are coupled to one another and folded about a common fold edge 566. A contact gap 568 exists between the first and second panel sections 562, 564. The panel section 562 includes a first runway 532 and has a first panel edge 563, and the panel section 564 includes a second runway 534 and a second panel edge 565 (FIG. 8). The mating pin 510 includes an elongated opening or void 590 that extends lengthwise along the mating pin 510 and partially separates the panel section 562 and the fold edge 566. The elongated opening 590 defines a bow region 592 of the panel section 562.

The bow region 592 bridges different portions of the panel section 562. The bow region 592 has a length that extends between a panel joint 593 and a panel joint 595. The bow region 592 has a width that extends between opposite edge portions 598, 599. The edge portion 598 is a portion of the panel edge 563, and the edge portion 599 partially defines the elongated opening 590. The bow region 592 includes at least a portion of the wipe zone 530, the resonance-control zone 532, and the mating zone 534. As shown in FIGS. 8 and 9, the bow region 592 also includes a protrusion 570. The protrusion 570 is a localized region of the bow region 592 that is bent outwardly.

The bow region 592 may be configured to reduce a mating force that resists the mating operation. More specifically, the resonance-control zone 532 (or the protrusion 570) and the other contact, such as the electrical contact 402, generate frictional forces during the mating operation. These frictional forces resist the mating operation or, in other words, increase the amount of force necessary to fully mate the electrical connectors. Collectively, the frictional forces from each electrical contact 500 may render the mating operation difficult to fully complete.

The bow region 592 may reduce these frictional forces while maintaining contact between the resonance-control zone 552 and the other contact. The bow region 592 is more compliant (or capable of being deflected) than panel sections that do not include the bow region. During the mating operation, the bow region 592 permits the protrusion 570 to be deflected inward such that a size of the contact gap 568 is reduced. More specifically, the bow region 592 bends or bows inward relative to the panel joints 593, 595 during the mating operation (as indicated by the arrow 580 in FIG. 8). The bow region 592 is more compliant or flexible than panel sections that do not include the bow region. By allowing the bow region 592 to be deflected inward, the frictional forces between the resonance-control zone 532 (or the protrusion 570) and the other contact may be reduced.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and/or the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector comprising:

a connector housing configured to engage another connector; and a plurality of electrical contacts coupled to the connector housing, each of the electrical contacts of the plurality of electrical contacts comprising:

a base section coupled to the connector housing;

an elongated mating pin coupled to the base section, the mating pin extending away from the base section along a longitudinal axis to a contact end of the mating pin, the mating pin having an exterior surface that forms a runway configured to intimately engage another contact during a mating operation, the runway including a wipe zone, a resonance-control zone, and a mating zone, the resonance-control zone being located between the mating zone and the wipe zone, wherein the resonance-control zone has a greater elevation than an elevation of the wipe zone and an elevation of the mating zone such that the resonance-control zone deflects the other contact further away during the mating operation.

2. The electrical connector of claim 1, wherein the wipe zone and the mating zone are essentially planar.

3. The electrical connector of claim 1, wherein each of the electrical contacts is stamped-and-formed from sheet material, the resonance-control zone being an embossed region of the sheet material.

4. The electrical connector of claim 1, wherein the mating pin includes two panel sections having a contact gap therebetween.

5. The electrical connector of claim 4, wherein the two panel sections are folded about a common fold edge.

6. The electrical connector of claim 4, wherein only one of the two panel sections includes the resonance-control zone.

7. The electrical connector of claim 4, wherein the panel sections are plated.

8. The electrical connector of claim 1, wherein the mating pin includes an elongated opening that extends parallel to the longitudinal axis, the elongated opening defining a bow region of the mating pin that is permitted to flex, the bow region including the resonance-control zone.

9. The electrical connector of claim 1, wherein the mating pin includes two panel sections having a contact gap therebetween that are folded about a common fold edge, the mating pin also including an elongated opening that extends parallel to the longitudinal axis along the fold edge and one of the panel sections, the elongated opening defining a bow region of the one panel section that is permitted to flex, the bow region including the resonance-control zone.

10. A communication system comprising:

a mating connector having a mating contact; and an electrical connector comprising a connector housing and a plurality of electrical contacts coupled to the connector housing, each of the electrical contacts of the plurality of electrical contacts comprising:

a base section coupled to the connector housing;

an elongated mating pin coupled to the base section, the mating pin extending away from the base section along a longitudinal axis to a contact end of the mating pin, the mating pin having an exterior surface that forms a runway configured to intimately engage another contact during a mating operation, the runway including a wipe zone, a resonance-control zone, and a mating zone, the resonance-control zone being located between the mating zone and the wipe zone, wherein the resonance-control zone has a greater elevation than an elevation of the wipe zone and an elevation of the mating zone such that the resonance-control zone deflects the other contact further away during the mating operation.

11. The communication system of claim 10, wherein the mating contact has a contoured end segment and the connector housing has an interior surface, the contoured end segment and the interior surface being shaped relative to one another such that the contoured end segment is blocked by the interior surface of the connector housing.

12. The communication system of claim 10, wherein the mating contact is configured to slidably engage the runway and move in an essentially linear direction along the runway during the mating operation, the wipe zone and the mating zone being essentially planar.

13. The communication system of claim 10, wherein each of the electrical contacts is stamped-and-formed from sheet material, the resonance-control zone being an embossed region of the sheet material.

14. The communication system of claim 10, wherein the mating pin includes two panel sections having a contact gap therebetween, the two panel sections being folded about a common fold edge, wherein only one of the two panel sections includes the resonance-control zone.

15. The communication system of claim 10, wherein the mating pin includes an elongated opening that extends parallel to the longitudinal axis, the elongated opening defining a bow region of the mating pin that is permitted to flex, the bow region including the resonance-control zone.

16. The communication system of claim 10, wherein the mating contact includes first and second contact fingers that oppose each other with a contact-receiving space therebetween, the electrical contact being disposed between the contact-receiving space, wherein:

the first contact finger has a contoured end segment and the connector housing has an interior surface, the contoured end segment of the first contact finger and the interior surface being shaped relative to one another such that the contoured end segment of the first contact finger is blocked by the interior surface of the connector housing;

the second contact finger has a contoured end segment, the contoured end segment of the second contact finger and the interior surface being shaped relative to one another such that a flex gap exists between the contoured end segment of the second contact finger and the interior surface of the connector housing, wherein the second contact finger is permitted to move during the mating operation.

17. An electrical contact comprising:

a base section; and an elongated mating pin coupled to the base section, the mating pin extending away from the base section along a longitudinal axis to a contact end of the mating pin, the mating pin having an exterior surface that forms a runway configured to intimately engage another contact during a mating operation, wherein the runway includes a wipe zone, a resonance-control zone, and a mating zone, the resonance-control zone being located between the mating zone and the wipe zone, wherein the resonance-control zone has a greater elevation than an elevation of the wipe zone and an elevation of the mating zone such that the resonance-control zone deflects the other contact further away during the mating operation.

18. An electrical contact of claim 17, wherein the mating pin includes two panel sections folded about a common fold edge and having a contact gap therebetween, the mating pin also including an elongated opening that extends parallel to the longitudinal axis along the fold edge and one of the panel sections, the elongated opening defining a bow region of the one panel section, the bow region being permitted to flex and including the resonance-control zone.

19. An electrical contact of claim 17, wherein the mating pin includes two panel sections having a contact gap therebetween, the two panel sections being folded about a common fold edge, wherein only one of the two panel sections includes the resonance-control zone.

20. An electrical contact of claim 17, wherein the mating pin includes an elongated opening that extends parallel to the longitudinal axis, the elongated opening defining a bow region of the mating pin that is permitted to flex, the bow region including the resonance-control zone.

* * * * *